United States Patent [19]

Plard et al.

[11] Patent Number: 4,577,093

[45] Date of Patent: Mar. 18, 1986

[54] DEVICE FOR ELECTRIC HEATING OF A GAS MIXTURE BY DIRECT JOULE EFFECT

[75] Inventors: Christian Plard, Le Pecq; Jacques Soulié, Paris, both of France

[73] Assignees: Electricite de France, Paris; Spie-Batignolles, Puteaux, both of France

[21] Appl. No.: 581,045

[22] Filed: Feb. 17, 1984

[30] Foreign Application Priority Data

Feb. 21, 1983 [FR] France ..... 83 02763

[51] Int. Cl.[4] ..... F24H 3/00

[52] U.S. Cl. ..... 219/376; 219/375; 219/374

[58] Field of Search ..... 219/374, 375, 376, 381, 219/382, 307, 280

[56] References Cited

U.S. PATENT DOCUMENTS

| | | | |
|---|---|---|---|
| Re. 23,795 | 3/1954 | Cartinhour | 219/374 X |
| 3,116,394 | 12/1963 | Barton | 219/376 |
| 3,626,153 | 12/1971 | Horton | 219/374 |

FOREIGN PATENT DOCUMENTS

| | | |
|---|---|---|
| 1263745 | 3/1968 | Fed. Rep. of Germany . |
| 1297252 | 6/1969 | Fed. Rep. of Germany . |
| 1567557 | 5/1969 | France . |
| 2029559 | 10/1970 | France . |
| 2418679 | 9/1979 | France . |

*Primary Examiner*—C. L. Albritton
*Assistant Examiner*—M. M. Lateef
*Attorney, Agent, or Firm*—Young & Thompson

[57] ABSTRACT

The high-power electric heating device is capable of heating gas mixtures such as a mixture of hydrocarbons and hydrogen to temperatures and pressures attaining 900° C. and 60 bar respectively. A central duct connects the gas mixture inlet to the outlet and is constituted by a plurality of superposed independently removable modules. Each module comprises a plurality of electric resistance elements formed by banks of adjacent metallic strips. A peripheral zone of the device contains power supply conductors connected to the modules. By means of passages in the form of slits between the central duct and the peripheral zone, a small fraction of the gas stream is permitted to flow within the peripheral zone.

7 Claims, 15 Drawing Figures

DEVICE FOR ELECTRIC HEATING OF A GAS MIXTURE BY DIRECT JOULE EFFECT

This invention relates to a high-power device for electric heating of a gas mixture by direct Joule effect, the mixture being heated to temperatures and pressures which can attain respectively 900° C. and 60 bar.

A primary object of the invention, which is not intended to imply any limitation, is to provide an electric heating device for equipping installations in which the following operations are performed:

reforming of petroleum naphtha in the presence of a platinum-base catalyst for obtaining gasolines;

hydrogen desulfurization of hydrocarbons.

In heating installations of this type, it is a desirable objective to replace traditional furnaces designed for the combustion of fossil fuel by electric furnaces which have distinctly superior thermal efficiency and permit easier and more accurate temperature regulation.

There are a number of known types of electric furnaces. As a general rule, these electric furnaces have a limited power rating which is distinctly lower than the power required (of the order of 10 MW) in the installations referred-to in the foregoing.

Furthermore, electric furnaces of known types usually have sheathed electric resistors which limit the power dissipated per unit area. Thus, if the rated power of a furnace of this type were increased to a value of the order of 10 MW, its overall size would be prohibitive, especially as the electric heating resistors have an effective cross-section which is considerably increased by the insulation and have to be placed at sufficient distances to ensure that they are not liable to produce an excessive pressure drop as the gas stream to be heated passes through the furnace.

Furthermore, these electric heating resistors cannot readily be employed for heating to high temperatures which may attain 900° C.

Electric furnaces equipped with electric heating resistors embedded in a fluidized particle bed are also known. Furnaces of this type, however, are not suited to applications in which it is necessary to heat a gas to a high temperature and at high pressure on account of the potential danger of entrainment of the fluidized-bed particles and of reaction between these latter and the gas.

Finally, the construction of an electric furnace in which a gas such as a mixture of hydrocarbons and hydrogen is intended to be heated to high values of temperature and pressure gives rise to many problems of gas-tightness, heat expansion, gas-tight lead-in bushings for the conductors which supply electric current to the resistors, high-temperature stability and corrosion resistance, which have not met with any satisfactory solution up to the present time.

The aim of the present invention is to overcome the deficiencies of known electric furnaces by producing a high-power electric heating device for heating gas mixtures such as a mixture of hydrocarbons and hydrogen to temperatures and pressures which may attain 900° C. and 60 bar respectively. This device has excellent thermal efficiency, is of relatively small overall size and produces a very small pressure drop as the gas mixture passes through the device.

The heating device contemplated by the invention comprises an enclosure which has an inlet and an outlet for the gas mixture and which contains bare electric resistors and the conductors for the supply of electric current to said resistors.

In accordance with the invention, this device essentially comprises a central duct which provides a connection between the inlet and outlet for the gas mixture. Said central duct is constituted by a plurality of superposed modules which are removable and independent of each other, each module being constituted by a plurality of electric resistance elements made up of banks of metallic strips placed in adjacent relation. The device further comprises a peripheral zone containing the conductors for the supply of electric current to the modules which contain the resistance elements. Passages are formed between the central duct and the peripheral zone in order to permit the flow of a small proportion of the gas stream within the peripheral zone.

At the time of operation of the heating device in accordance with the invention, the gas stream flows through the central duct which is constituted by a plurality of removable and superposed modules. The assembly consisting of all the modules is capable of expanding freely independently of the connections and of the outer shell without giving rise to any harmful stresses.

The fact that the electric heating resistors are strips placed in adjacent relation makes it possible to obtain a large amount of power dissipated per unit area and consequently a relatively small bulk. Furthermore, these strip resistors offer practically no resistance to the gas flow and make it possible to obtain a very small pressure drop.

Moreover, the conductors which supply electric current to the resistors and which are placed in the peripheral zone are cooled by a small portion of the gas stream which penetrates into the enclosure of the device, with the result that the problem of high-temperature stability of these conductors is effectively solved.

Also noteworthy is the fact that the modules are removable. It is thus possible to replace a faulty element without interfering with the other elements.

This principle makes it possible in addition to adapt the power required for each furnace by varying the number of stacked modules, only the length of the outer shell being modified.

Furthermore, these modules which are supplied separately from regulated electric power sources make it possible to obtain between the inlet and outlet of the device a temperature profile which is perfectly suited to the desired optimum conditions.

In an advantageous embodiment of the invention, the enclosure has a domed bottom section provided with a gas mixture inlet nozzle on which is removably mounted a heat-insulated vertical shell, the top portion of which is adapted to carry a gas mixture outlet nozzle. The modules containing the electric resistors are stacked one above the other along the axis of the shell and are supported by the domed bottom section. Said modules are free with respect to the side wall and with respect to the top wall of the shell. The wall of the domed bottom section is provided with lead-in bushings for the conductors which supply electric current to the resistance elements.

Moreover, the fluid-tight junction between the shell and the remainder of the device is limited to a simple seal between said shell and the domed bottom section, thus limiting any danger of leakage caused by the high pressure of the gas which flows within the device.

In a preferred embodiment of the invention, the modules are constituted by parallelepipedal sheet-metal boxes having closed sides and removably fixed on the general internal support frame. Said boxes are placed one above the other in the line of extension of their lateral faces. Each box contains a plurality of banks of sheet-metal resistance strips disposed in parallel relation, the faces of these strips being parallel to the axis of the shell. The resistance strips are preferably formed of expanded sheet metal.

The construction of these modules is both simple and conducive to minimum bulk. The use of strips of expanded metal makes it possible to obtain a high ohmic value per unit area with a good temperature distribution by virtue of the turbulent flow generated by the small projecting louvers of expanded metal.

Preferably, the conductors for supplying electric current to the modules are metal tubes which extend vertically in a direction parallel to the axis of the shell within the peripheral zone. These tubes are connected to the resistance elements of the modules by means of flexible braided-wire elements.

Thus the electric conductors, while being cooled in the peripheral zone, are capable of expanding freely without thereby exerting stresses on the connection areas of the resistors.

Other features of the invention will be more apparent upon consideration of the following description and accompanying drawings, wherein.

Figure 1:
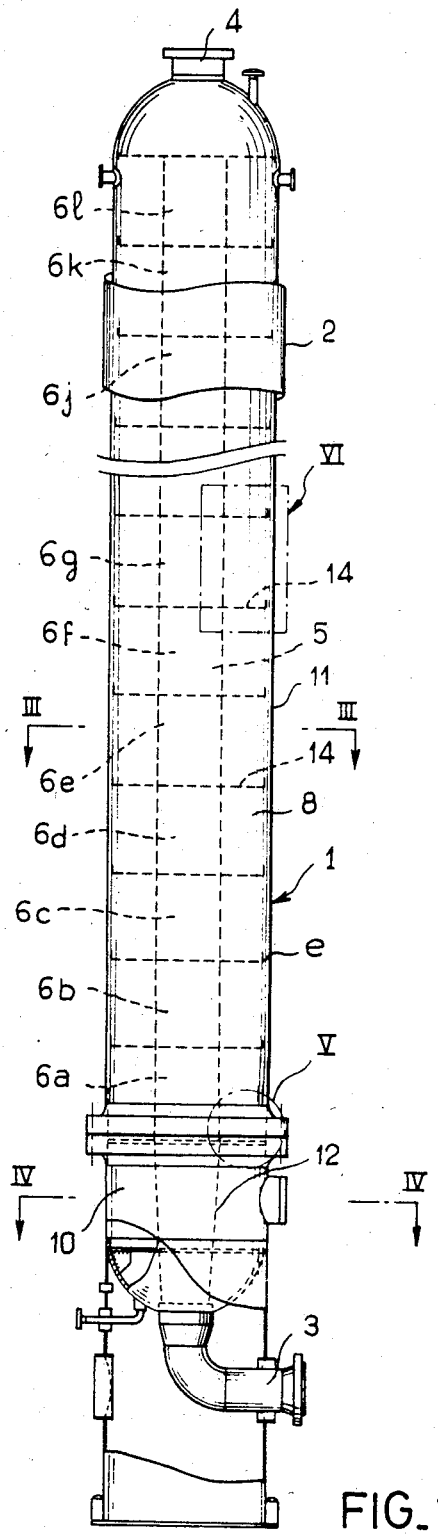
FIG. 1 is a fragmentary view in elevation showing an electric heating device in accordance with the invention.
Figure 12:
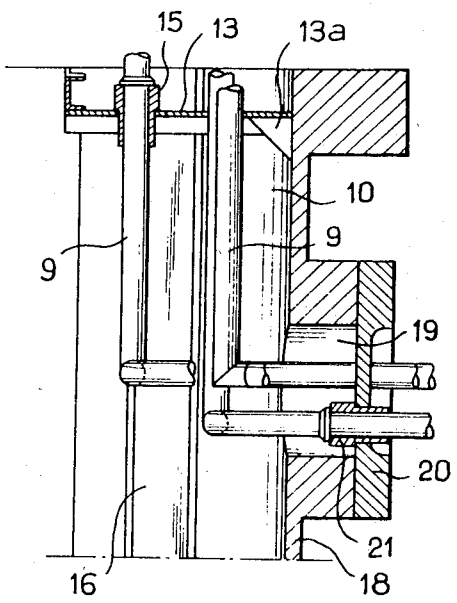
Figure 11:
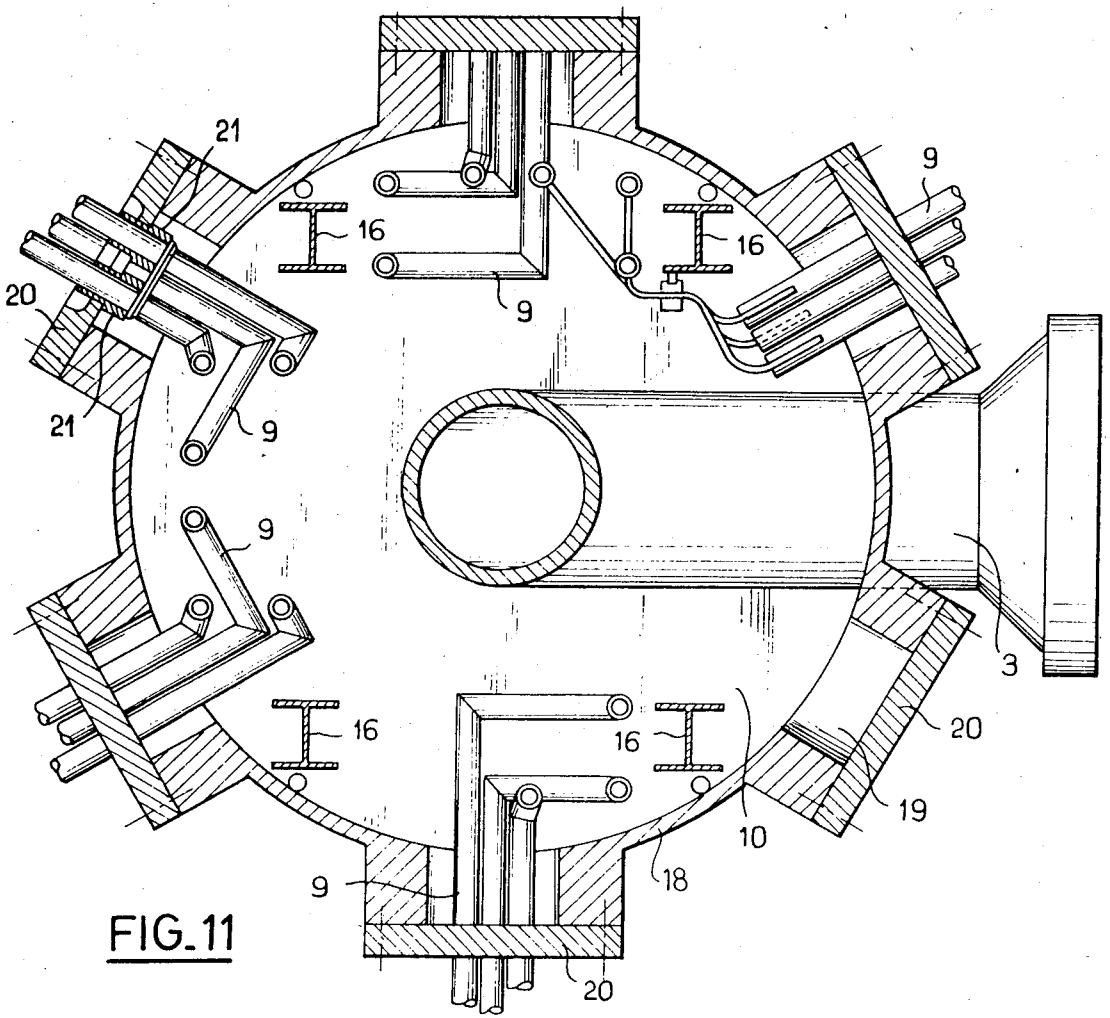
Figure 14:
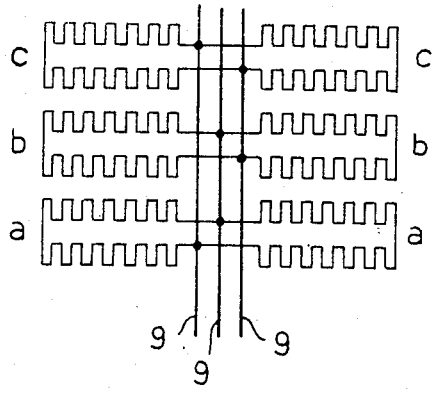
Figure 15:
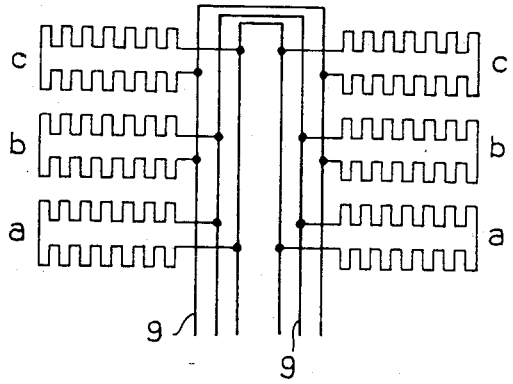
Figure 13:
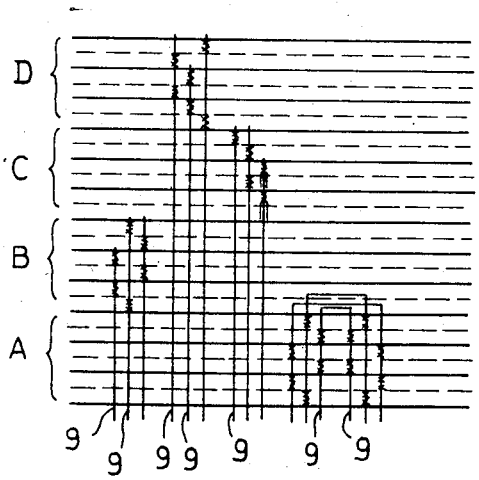

FIG. 11 is a sectional view to a larger scale along the plane IV—IV of FIG. 1 and shows the lead-in connections for the electric conductors which supply the resistors of the device in accordance with the inventio FIG. 12 is a large-scale longitudinal part-sectional view of the domed bottom section of the device and shows the lead-in connections for the electric conductors which supply the resistors;

FIG. 13 is a diagram showing the electric connection between the different superposed modules;

FIG. 14 is an electrical diagram showing a mode of connection betwen the conductors and the resistors of a standard module;

FIG. 15 is an electrical diagram showing a mode of connection between the conductors and the resistors of a high-performance module.

In the embodiment of FIGS. 1 to 4, there is shown a high-power device for electric heating of a gas mixture by direct Joule effect, the mixture being heated to temperatures and pressures which may attain 900° C. and 60 bar respectively.

This device comprises a vertical enclosure 1 of generally cylindrical shape and provided with an internal heat-insulating lining or external heat-insulating jacket 2 which is shown only partially in FIG. 1. The lower end of the enclosure 1 comprises a domed bottom section with an inlet nozzle 3 and the upper portion of the enclosure comprises a shell with a top outlet nozzle 4 for the delivery of the gas mixture to be heated.

Said enclosure 1 has a central duct 5 as shown in dashed outline in FIG. 1. Said duct connects the gas mixture inlet 3 to the outlet 4 and contains a plurality of identical modules 6*a*, 6*b*, 6*c*, 6*d*, . . . 6*k*, 6*l*) which are placed in superposed relation and are removable.

These modules 6*a*, . . . 6*l* each comprise a plurality of banks of resistance elements which are coupled in series and in parallel.

Figure 2:
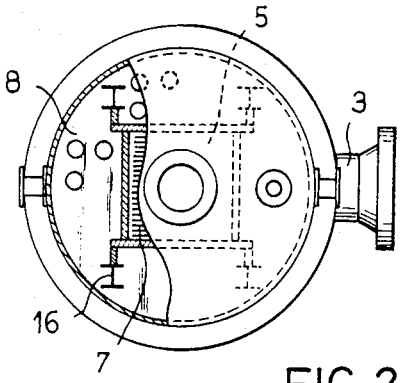
FIG. 2 is a fragmentary plan view to a larger scale showing the top portion of the device.
Figure 3:
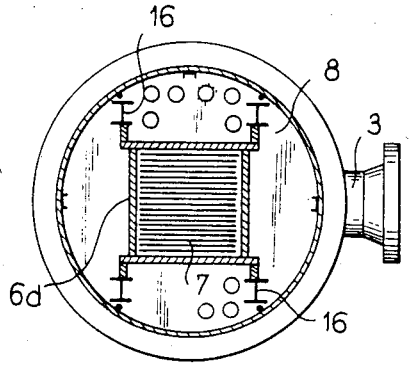
FIG. 3 is a sectional view to a larger scale and taken along the plane III—III of FIG. 1.
Figure 4:
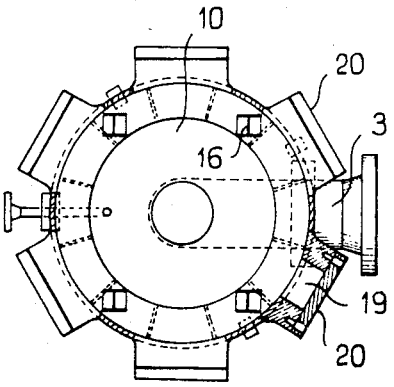
FIG. 4 is a sectional view to a larger scale, this view being taken along the plane of junction between the domed bottom section and the shell.
Figure 6:
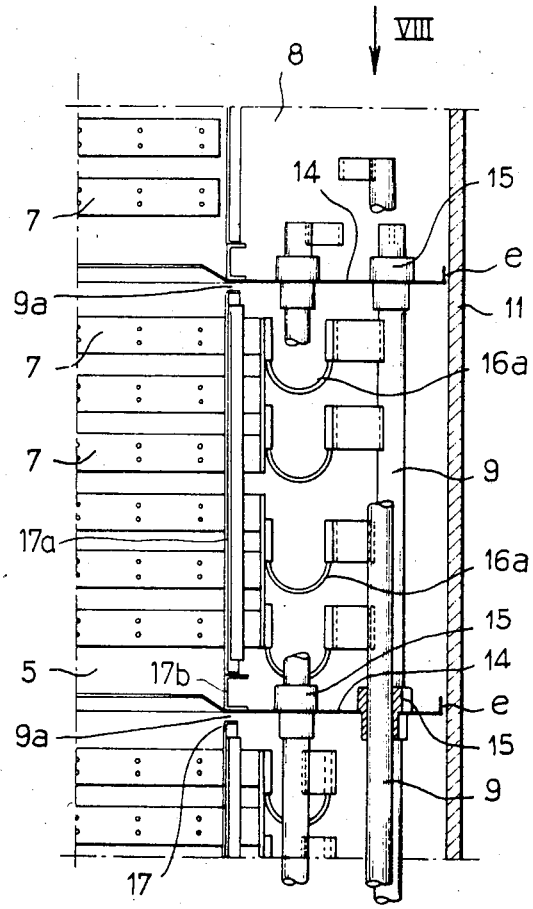
FIG. 6 is a longitudinal sectional view to a large scale and shows the detail VI of FIG. 1.
Figure 7:
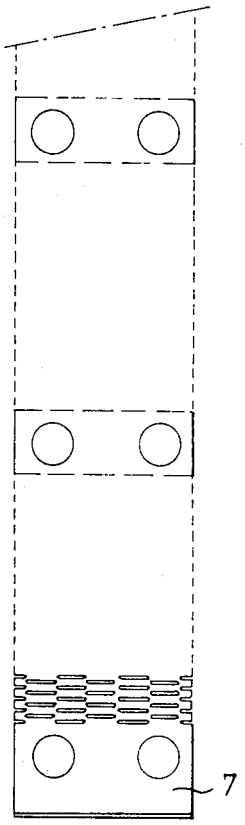
FIG. 7 is a partial view of a resistance strip of the device.

As shown in FIGS. 2 and 3, and more clearly in FIGS. 6, 7, 9 and 10, the aforementioned resistance elements consist of metallic strips 7 placed in adjacent relation. These resistance strips 7 are of bare expanded sheet metal (as shown in FIG. 7) and are arranged parallel to the vertical axis of the device. These strips have a thickness of a few tenths of a millimeter and are maintained in spaced relation by heat-resistant insulating rings (of alumina, for example). The spacing between the resistance strips 7 is so determined as to obtain optimum heat transfer between these strips and the gas to be heated and to provide a minimum bulk while nevertheless being sufficient to ensure that the pressure drops are negligible. In practice, the resistance strips 7 have a relative spacing of one to two centimeters for electrical insulation between strips at different potentials.

The central duct 5 constituted by the superposed modules 6*a*, . . . 6*l* is surrounded by a peripheral zone 8 (as shown in FIGS. 1, 2, 3, 6 and 8 to 10) containing the conductors 9 for supplying electric current to the modules 6*a*, . . . 6*l* which enclose the resistance strips 7.

Moreover as shown in FIG. 6, passages 9*a* are formed between the central duct 5 and the peripheral zone 8 in order to permit the flow of a small proportion of the gas stream into the peripheral zone 8 for the purpose of cooling the tubes and balancing the pressures between the central duct and the peripheral zone.

As indicated in FIGS. 1, 4, 11 and 12, the enclosure 1 has a domed bottom section 10 provided with the inlet nozzle 3 for admission of the gas mixture. A vertical shell 11 is removably mounted on said bottom section in fluid-tight manner and adapted to carry the top nozzle 4 through which the gas mixture to be heated is discharged.

The superposed modules 6*a*, . . . 6*l* contained within the shell 11 are placed one above the other along the vertical axis of the shell. Said modules communicate with the inlet nozzle 3 by means of a coupling sleeve 12 which is widened-out at the top (as shown in FIG. 1). Moreover, said modules 6*a*, . . . 6*l* are free with respect to the side wall and the top portion of the shell 11.

As shown in FIGS. 2, 3, 6, 9 and 10, the modules 6*a*, . . . 6*l* are constituted by parallelepipedal sheet-metal boxes which are closed at the sides and removably fixed one above the other in the line of extension of their lateral faces.

Figure 5:
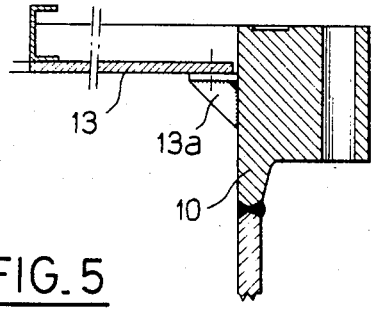
FIG. 5 is a longitudinal sectional view to a larger scale and shows the detail V of FIG. 1.

The complete assembly formed by all the modules 6*a*, . . . 6*l* rests on a bottom plate 13 (as shown in FIG. 5) which is in turn supported on an internal ledge 13*a* of the domed bottom section 10.

As shown in FIGS. 1, 6, 9 and 10, each module 6*a*, . . . 6*l* is supported by a peripheral plate which extends over practically the entire width of the peripheral zone. This plate is in turn fixed on the general internal support frame 16. The small clearance space e provided between the outer edge of these peripheral module plates 14 and the wall of the shell 11 is calculated so as to ensure that said plates 14 are capable of expanding under the action of the heat generated by the electric resistors contained within the modules 6*a*, . . . 6*l* but are not liable to come into contact with the wall of the shell 11.

Figure 8:
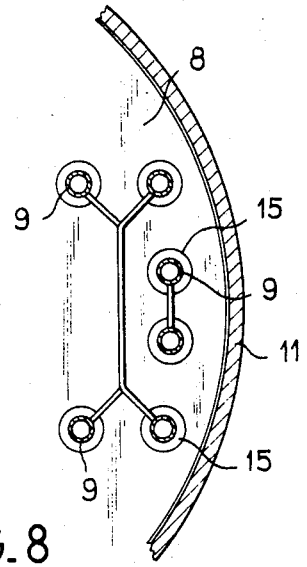
FIG. 8 is a view looking in the direction of the arrow VIII of FIG. 6.
Figure 9:
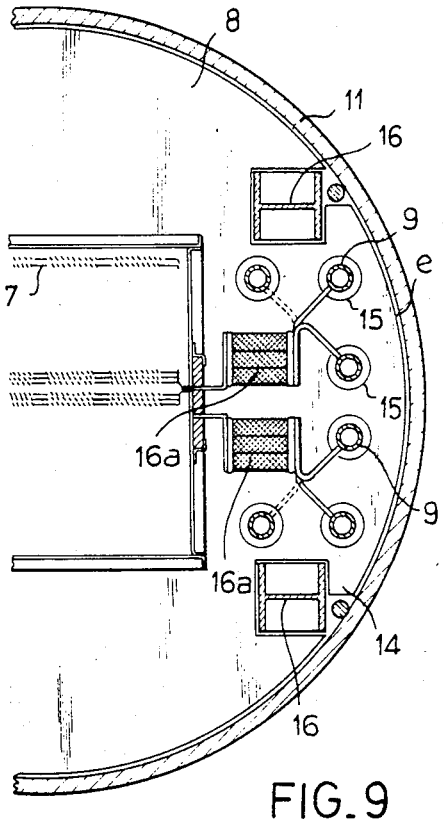
FIG. 9 is a large-scale transverse part-sectional view of the device and shows the connection between the supply conductors and the electric resistors.
Figure 10:
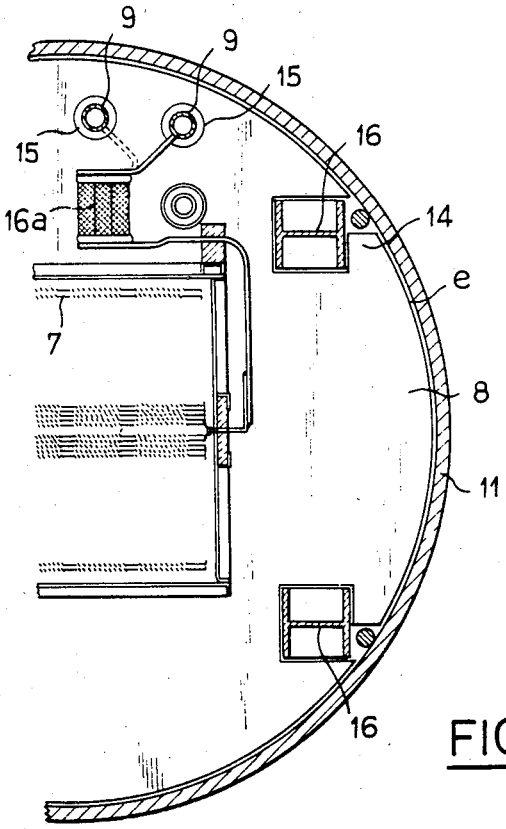
FIG. 10 is a view which is similar to FIG. 9 and shows another mode of connection between the conductors and the resistors, thus permitting a peripheral distribution of the conductors.

The module plates 14 are provided with openings in which are engaged sleeves 15 of insulating material which surround the electric conductors 9 for supplying current to the modules 6*a*, . . . 6*l* (as shown in FIG. 6 and in FIGS. 8 to 10).

The complete assembly consisting of said modules 6*a*, . . . 6*l* is attached laterally to vertical structural members 16 (H-section members, for example) which extend within the peripheral zone 8 (as shown in FIGS. 2, 3, 9 and 10) and serve to support the internal equipment components.

The electric conductors 9 for supplying current to the modules 6*a*, . . . 6*l* are metal tubes which extend (as shown in FIG. 6 and in FIGS. 8 to 10) in a direction parallel to the axis of the shell 11 within the peripheral zone 8. These metal tubes 9 are connected by means of flexible braided-wire elements 16*a* to the electric resistance strips 7 contained within the modules 6*a*, . . . 6*l*.

In the embodiment illustrated (see FIG. 6), each module 6*a*, . . . 6*l* comprises two superposed sets of resistance strips 7. It is also shown in FIG. 6 that each module communicates with the adjacent peripheral zone 8 by means of a slit 9*a* having a width of a few millimeters and formed between the top edge 17 of the side wall of a module and the base plate 14 which supports the upper module. As can be seen in FIG. 6, each such side wall is comprised by a plate 17*a* and a member 17*b* of C-shaped cross section.

FIGS. 11 and 12 show that the domed bottom section 10 is provided in its side wall 18 with radial lead-in bushings 19 for the conductor tubes 9 which supply electric current to the modules 6*a*, . . . 6*l*.

Said lead-in bushings 19 are sealed by metal closure disks 20 traversed by insulating sleeves 21 which surround the metal conductor tubes 9. These tubes pass horizontally through the lead-in bushings 19, then extend vertically within the bottom compartment 10 and pass through the bottom support plate 13 of the module assembly.

In the example of FIG. 11, it is apparent that the domed bottom section 10 has five lead-in bushings 19 each traversed by three conductors 9 and a sixth passage which is left in reserve. The number of equipped penetrations is a function of the power and number of modules.

FIGS. 13 to 15 show the principle of electric power supply to the resistance modules of the device in accordance with the invention.

The different modules illustrated diagrammatically in FIG. 13 are placed in superposed relation at four levels A, B, C, D, each level being composed of three modules. The upper levels B, C, D are each supplied by means of three conductors 9 in the manner shown diagrammatically in FIG. 14. In this figure, each single-phase element such as a, b, represents one module (for example the module 6*e*) which is supplied with single-phase power. A level such as B, C or D is formed of three single-phase modules and corresponds to a power rating within the range of 2 to 3 MW.

Each single-phase element such as a, b is composed of two banks which consist of twice twenty-seven resistance strips 7.

The bottom level A is supplied by means of a pair of three conductors 9 as shown more clearly in FIG. 15. In this mode of power supply, the power attains 4 to 5 MW.

The electric heating device which has just been described offers many advantages over designs of the prior art.

In the first place the device can readily be disassembled for such purposes as repair work, for example. To this end, it is only necessary to remove the shell 11 which surrounds the assembly of modules. This operation is particularly simple by reason of the fact that said shell is completely free with respect to the modules and their power supply conductors.

Moreover, the conductors 9 which supply electric power to the modules are subjected to efficient cooling by a small portion of the gas stream which flows within the peripheral zone 8, thus guaranteeing durability of the modules over an extended period of service.

Furthermore, the awkward problems arising from thermal expansion of the heating elements have been overcome in a simple and effective manner by virtue of the fact that the assembly of modules is capable of expanding freely toward the top portion of the shell 11.

It is also worthy of note that, in spite of the large amount of power dissipated per unit volume of the device, it has been possible to achieve a very small pressure drop by virtue of the small thickness of the resistance strips 7. This in turn permits a considerable reduction in power of the compressors and pumps employed for compressing and transporting the gas to be heated through the heating device.

Again another advantage is that the heating power delivered by each element can be adjusted independently of the other levels since the levels are each supplied separately.

Thus it is possible to obtain between the inlet and the outlet of the device an optimum temperature profile under the heating conditions which may be desired in the case of a specific application.

Furthermore, the device in accordance with the invention is perfectly suited to heating of a gas under pressures which attain or exceed 60 bar, especially by virtue of the fact that the shell 11 is joined to the bottom section 10 of the device by means of a single seal and is not fitted with any coupling connector for the introduction of electric conductors or other elements, thus considerably limiting any danger of gas leakage.

It will be readily understood that the invention is not limited to the example described in the foregoing and that any number of modifications may accordingly be contemplated without thereby departing from the scope of the invention.

From this it follows that the modules 6*a*, . . . 6*l* may not necessarily be parallelepipedal but could be cylindrical or could have any other tubular shape.

It should be added that the resistance strips 7 need not be of expanded metal and could be produced in a different manner. The only essential condition to be satisfied is that these strips must be provided with cutout portions which permit enhanced resistance per unit area without affecting the free flow of gas to be heated between these strips.

It will be clearly apparent that, although this example makes provision for a three-phase alternating-current supply, this does not imply any limitation. The device in accordance with the invention can be supplied with any type of electric current and in particular direct current.

The electric furnace described in this application can advantageously be employed in the method described in French patent Application No. 83 02764 filed on Feb. 21, 1983, and entitled: "An installation for chemical conversion of a gas mixture containing hydrogen and hydrocarbons".

What is claimed is:

1. A high-power device for electric heating of a gas mixture by direct Joule effect, the mixture being heated to temperatures and pressures up to 900° C. and 60 bar respectively, the device being constituted by an enclosure which has a lower inlet and an upper outlet for the gas mixture and which contains bare electric resistors and conductors for the supply of electric current to said resistors, wherein said device comprises a central duct having a lower end directly connected to said lower inlet and an upper end facing said upper outlet, said central duct being constituted by a plurality of superposed modules which are removable independently of each other, each module being constituted by a plurality of electric resistance elements made up of banks of metallic strips placed in relation, said strips being parallel to each other and to the direction along which the gas mixture flows between said inlet and said outlet of the enclosure, a peripheral zone containing the conductors for the supply of electric current to the resistance elements, and a plurality of passages formed between the central duct and the peripheral zone in order that a small proportion of the gas flow which passes through the central duct may be permitted to flow within the peripheral zone.

2. A device according to claim 1, wherein the enclosure has a domed bottom section provided with a gas mixture inlet nozzle on which is removably mounted a heat-insulated vertical shell whose top portion is adapted to carry a gas mixture outlet nozzle, wherein the modules containing the resistance elements extend one above the other along the axis of the shell, are supported by the general structural framework which rests on the domed bottom section, and are free with respect to the side wall and the top portion of the shell, and wherein the wall of the domed bottom section is provided with lead-in bushings for the conductors which supply electric current to the modules containing the resistance elements.

3. A device according to claim 1, wherein the strips are formed of expanded sheet metal.

4. A device according to claim 3, wherein the assembly of modules rests on base plates attached to a general structural framework which is in turn supported by the domed bottom section.

5. A device according to claim 4, wherein each module support plate extends over practically the entire width of the shell, said plates being provided with openings fitted with insulating sleeves through which conductors for supplying electric current to the modules are intended to pass.

6. A device according to claim 5, wherein the conductors for supplying electric current to the modules are metal tubes which extend in a direction parallel to the axis of the shell within the aforementioned peripheral zone, said tubes being connected to the resistance elements of the modules by means of flexible braided-wire elements.

7. A device according to claim 6, wherein each module is adapted to communicate with an adjacent peripheral zone via a passage formed between the upper portion of each module and the bottom support plate of the upper module and wherein the peripheral zones are adapted to communicate with each other via slits formed between the outer edge of each bottom support plate and the wall of the shell.

* * * * *